United States Patent [19]

Sharland et al.

[11] 4,193,375

[45] Mar. 18, 1980

[54] FLOOR PROTECTING DOOR PAINTING SHIELD

[75] Inventors: Stanley G. Sharland, Garden Grove; Angelo R. Mecca, Costa Mesa, both of Calif.

[73] Assignee: Douglas M. Lightfoot

[21] Appl. No.: 910,676

[22] Filed: May 30, 1978

[51] Int. Cl.[2] ..... B05C 21/00

[52] U.S. Cl. ..... 118/504; 15/257 R

[58] Field of Search ..... 118/504, 505; 101/127, 101/127.1; 15/257 R; 51/262 R, 274, 310, 270

[56] References Cited

U.S. PATENT DOCUMENTS

| | | | |
|---|---|---|---|
| 2,332,579 | 10/1943 | Kirby | 118/505 |
| 2,721,809 | 10/1955 | Marks et al. | 118/505 |
| 4,023,488 | 5/1977 | Zimmer | 101/127.1 |
| 4,068,792 | 1/1978 | Dixon | 118/505 |

*Primary Examiner*—John P. McIntosh

*Attorney, Agent, or Firm*—William C. Babcock

[57] ABSTRACT

An elongate floor protecting door painting shield that may be removably secured to a wood door under the lower horizontal edge surface thereof to define two elongate areas on each side of the door to receive spilled paint and prevent the latter defacing the floor surface over which the door is disposed. The shield is preferably formed from a resilient sheet material, and the resiliency of this sheet material being used to maintain the shield in place on the door as the latter is pivoted during a painting operation.

4 Claims, 4 Drawing Figures

FIG. 1
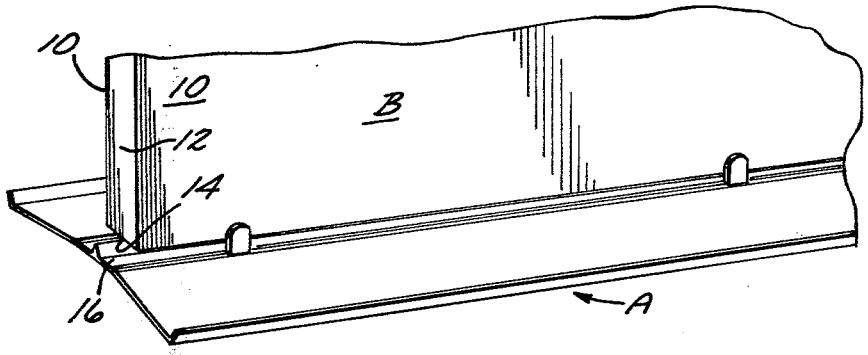
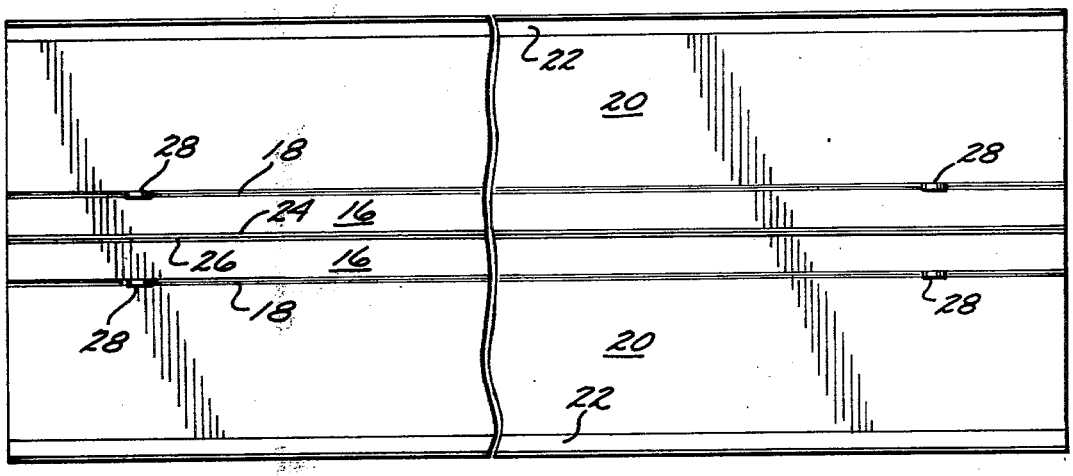
FIG. 2
FIG. 4
FIG. 3
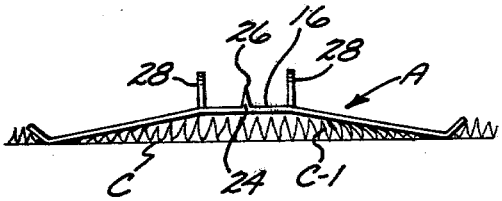
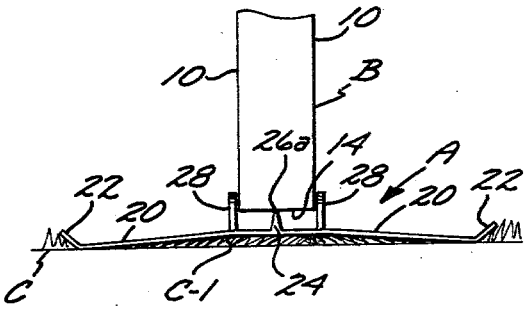

FLOOR PROTECTING DOOR PAINTING SHIELD

BACKGROUND OF THE INVENTION

1. Field of the Invention

Elongate floor protecting door painting shield.

2. Description of the Prior Art

In the past, the painting of a door without allowing spilled paint to damage and deface the floor underneath the door has presented a troublesome problem. Normally newspapers or like sheet material is placed under the door and over the floor that is to be protected from spilled paint. However, this is not a satisfactory solution, for as the door is pivoted on its hinges during the painting operation the newspaper or sheet material may become rumpled and stick to the lower painted side surfaces of the door, the newspaper be displaced from under the door, or paint spilled from the newspaper after the latter is being removed from under the door after the painting operation is completed, with the spilled paint falling onto the floor surface.

The primary purpose in devising the present invention is to provide a simple, inexpensive floor protecting shield that is removably secured to the lower edge portion of a door prior to the painting of the latter, with the shield having arms that extend outwardly from opposite sides thereof onto which spilled paint may fall, and the shield capable of being removed from the door after the painting operation is completed, without danger that paint that has fallen onto the shield will be displaced therefrom onto the floor surface.

Another object of the present invention is to provide a painting shield that may be fabricated from light weight, resilient, sheet material, that is inexpensive, is simple and easy to use, and may be reused from a number of painting operations by simply removing the spilled paint therefrom.

A still further object of the invention is to provide a paint shield, in which the resiliency of the sheet material defining the same is utilized in maintaining the shield in removable engagement with the lower edge surface of the door during the painting operation.

SUMMARY OF THE INVENTION

The floor protecting door painting shield includes an elongate member formed from a resilient sheet and of a length at least as great as the width of the door that is to be painted. The member has a transverse cross-section that includes a substantially flat center portion that is of a width at least as great as the thickness of the door. Two arms of substantial length extend downwardly and outwardly in opposite directions from the sides of the center portion, with the arms being at such an angle that when the shield is disposed under a door and the outer edges of the arms are in contact with the floor, the center portion of the shield will be forced upwardly towards the under edge surface of the door. A pair of lips extend upwardly from the outer edges of the arms, and serve to prevent paint spilled on the upper surface of the arms flowing therefrom onto the floor surface. In the preferred form of the invention an elongate rib extends upwardly from the center portion, and defines a sharp knife edge surface that is forced into the wood of the underedge surface of the door due to the resiliency of the arms, and the rib serving to prevent inadvertent displacement of the shield from a protecting position on the door when the door is pivoted during a painting operation. To prevent inadvertent displacement of the shield from the underedge surface of the door, two pairs of sequentially spaced tabs extend upwardly from the longitudinal edge surfaces of the center portion, and are adjacently disposed to the lower side surfaces of the door, and assure that the shield will not be displaced from the door when the door is pivoted relative to the floor surface.

BRIEF DESCRIPTION OF THE DRAWING

FIG. 1 is a perspective view of the floor protecting shield removably secured to the under portion of a door to prevent paint spilled in the painting of the door from falling onto the floor surface situated under the door;

FIG. 2 is a top plan view of the paint shield illustrated in FIG. 1;

FIG. 3 is an end elevational view of the paint shield; and

FIG. 4 is the same view of the paint shield as shown in FIG. 3 but removably secured to the lower portion of a door.

DESCRIPTION OF THE PREFERRED EMBODIMENT

The floor protecting door painting shield A as may be seen in FIG. 1 is adapted to be used with a wood door B that is pivotally supported by means (not shown), to be swung over a portion of a floor C, which floor may have a rug C-1 thereon.

The door B includes two laterally spaced side surfaces 10, a free vertical edge surface 12, and a lower horizontal edge surface 14.

The floor protecting door painting shield A is preferably formed from a light weight, resilient, sheet material, which, by conventional forming operations, is shaped to define an elongate longitudinal center portion 16 that has two laterally spaced parallel longitudinal edges 18. The center portion 16 at the longitudinal edges 18 develops into two oppositely disposed downwardly and outwardly extending pair of arms 20 that are of substantial width, and on their upper surface serve to receive spilled paint from the door B. The arms 20 on the outer longitudinal edges thereof develop into two upwardly extending lips 22 as best seen in FIG. 3.

The center portion 16 at substantially the center thereof has an elongate longitudinal rib 24 projecting upwardly therefrom, which rib at the upper extremity thereof defines a sharp knife edge 26. Two pairs of longitudinally spaced laterally separated tabs 28 extend upwardly from the longitudinal edges 18 as may be seen in FIG. 3, and removably engage the lower portions of the sides 10 to assist in positioning the shield A on the door B by sliding the shield onto the lower portion of the door while the shield rests on the floor C. When the shield A is moved longitudinally relative to the door B to position the shield thereon as shown in FIG. 4, the resiliency of the arms 20 is sufficient to urge the rib 24 upwardly relative to the lower edge surface 14 of the door to the extent that the knife edge 26 cuts into the door to removably hold the shield in the protecting position on the door as shown in FIG. 1. It will be apparent that the rib 24 not only serves its function but also the tabs 28 assist in holding the shield removably on the door when the latter is pivoted, and as a result the door may be pivoted during the painting operation without it being disengaged from the door, and paint spilled in the painting of the door dropping onto the floor C or a rug or carpet C-1 that may cover the floor.

After the painting of the door B has been performed, the shield A is removed therefrom by sliding the latter longitudinally relative to the door, with the groove 26a formed in the door edge surface 14 serving to guide the shield A longitudinally relative to the door so that the tabs 28 do not physically contact the lower side surfaces of the door that have been painted. Although the tabs 28 are not in physical contact with the side surfaces, they do cover a portion of the door during the painting operation, which portion must be painted after the shield A is removed from the door.

The use and operation of the invention has been described previously in detail and need not be repeated.

What is claimed is:

1. A floor protecting door painting shield for use with a pivotally supported wood door that may be pivoted during a painting operation thereon that includes:

a. an elongate member formed of a resilient sheet and of a length at least as great as the width of the door that is to be painted, said elongate member having a transverse cross-section that includes a substantially flat center portion that is of a width at least as great as the thickness of said door, two arms of substantial length that extend downward and outwardly in opposite directions from opposite sides of said center portion at such an angle that when the shield is disposed under a door and the outer edges of said arms are in contact with the floor under said door, said center portion is forced upwardly due to the resiliency of said arms towards pressure contact with the under edge surface of said door, and a pair of lips that extend upwardly from the outer longitudinal edges of said arms to prevent paint spilled on the upper surface of said arms flowing therefrom onto said floor; and b. first means that extend upwardly from said elongate member to removably engage said door and prevent said elongate member from being disengaged from said door when said door is pivoted relative to said floor during the painting of said door.

2. A floor protecting door painting shield as defined in claim 1 in which said first means is an elongate rib that projects upwardly from said center portion, said rib defining an upwardly disposed longitudinally extending knife edge that is forced into the wood defining the lower edge surface of said door.

3. A floor protecting door painting shield as defined in claim 2 in which said first means also includes a pair of sequence of longitudinally spaced tabs that extend upwardly from opposite longitudinal edges of said center portion and removably engage opposite lower side portions of said door.

4. A floor protecting door painting shield as defined in claim 1 in which said first means are a pair of sequence of longitudinally spaced tabs that extend upwardly from opposite longitudinal edges of said center portion and removably engage opposite lower side portions of said door.

* * * * *